United States Patent [19]

Mazur et al.

[11] 4,452,201

[45] Jun. 5, 1984

[54] AUTOMATIC IDLE SPEED ACTUATOR VALVE

[75] Inventors: Richard J. Mazur, Northville; Lawrence W. Tomczak, Rochester; Salim A. Momin, Troy; Howard R. Killen, Rochester, all of Mich.

[73] Assignee: Chrysler Corporation, Highland Park, Mich.

[21] Appl. No.: 497,965

[22] Filed: May 25, 1983

[51] Int. Cl.[3] ..... F02D 11/10

[52] U.S. Cl. ..... 123/339; 123/585; 251/133; 251/134

[58] Field of Search ..... 123/339, 585, 586, 587, 123/588, 589; 251/133, 134

[56] References Cited

U.S. PATENT DOCUMENTS

| | | | |
|---|---|---|---|
| 4,244,685 | 1/1981 | Lahtinen | 251/133 |
| 4,325,349 | 8/1982 | Fehrenbach | 123/585 |
| 4,369,755 | 1/1983 | Saito | 123/585 |
| 4,398,562 | 8/1983 | Saarem | 251/134 |
| 4,411,231 | 10/1983 | Watanabe | 123/339 |
| 4,428,356 | 1/1984 | Kemmner | 123/339 |

*Primary Examiner*—Ronald B. Cox

*Attorney, Agent, or Firm*—Mark P. Calcaterra

[57] ABSTRACT

An auxiliary air by-pass actuator valve of small size is disclosed which provides a quick response to the changing RPM of the engine due to changing loads. The actuator employs a stationary D-shaped orifice in communication with a rotatable valve member and D-shaped disc to regulate the amount of auxiliary air which by-passes the throttle blade in an electronic fuel injection system.

10 Claims, 5 Drawing Figures

FIG. 3.
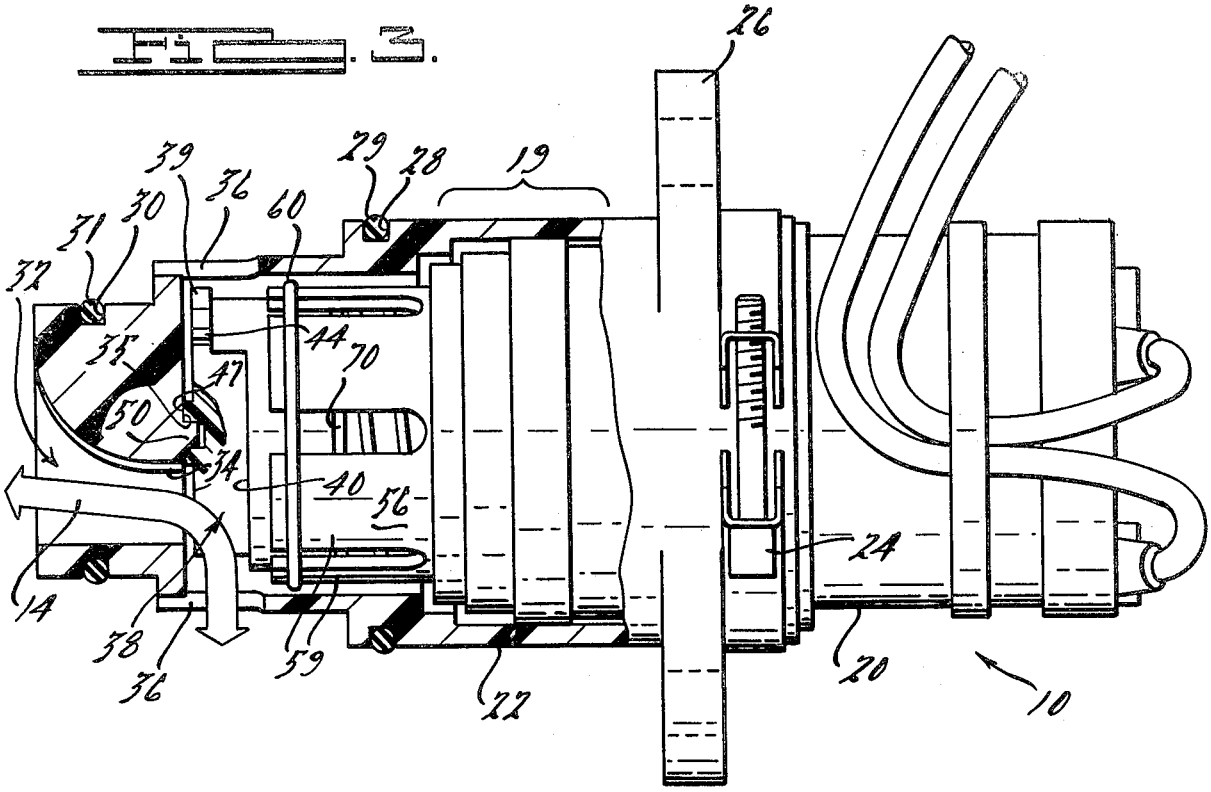
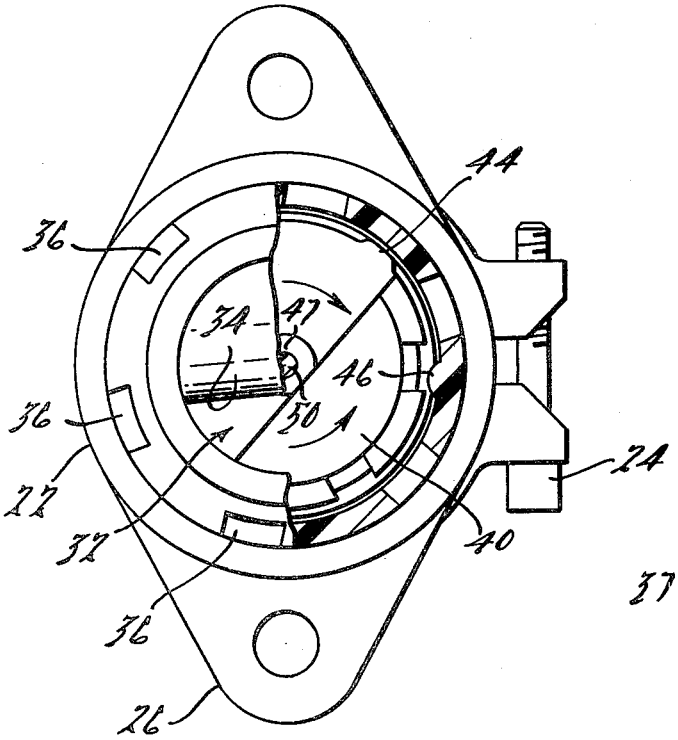
FIG. 5.
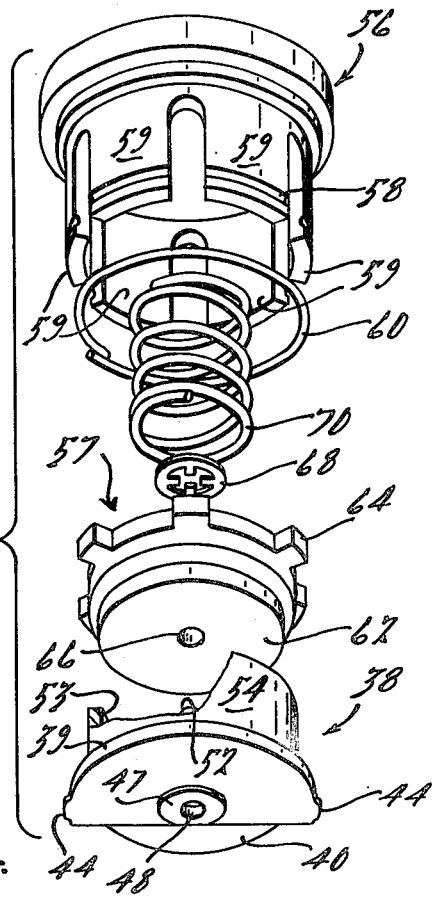
FIG. 4.

AUTOMATIC IDLE SPEED ACTUATOR VALVE

BACKGROUND AND SUMMARY OF THE INVENTION

The invention relates to electronic fuel injection systems for internal combustion engines which employs an auxiliary air port to by-pass the throttle blade. More specifically, the invention relates to the art of varying the amount of auxiliary air which by-passes the throttle blade by changing the variable cross sectional opening of the auxiliary air port actuator in response to electrical pulses from a controller. The pulses are based on RPM changes due to changing loads on the engine. This air by-pass actuator is especially helpful at very low engine idle speeds where the throttle blade is nearly closed. The auxiliary air is supplied via the actuator in the by-pass port to control idle speed in response to engine loads, such as that due to air conditioning, automatic transmission, electrically heated backlights, etc.

An air by-pass valve representative of the prior art appears in U.S. Pat. No. 4,325,349.

One of the objects of the invention is to provide an auxiliary air by-pass actuator valve which is small in size.

Another object of the invention is to provide an auxiliary air by-pass actuator valve which can quickly respond to changing engine load signals.

The actuator valve described and claimed herein employs an air passage, which comprises a D-shaped orifice, a D-shaped notch and multiple orifices, gear reduction means and a motor assembly to drive the valve between the open and the closed postions, and a clutch assembly which helps to prevent the stalling of the motor if the valve reaches the full open or full closed position stops.

Accordingly, the present invention has among its further objects to provide an improved form of actuator valve employing a generally D-shaped valve and multi-fingered clutch.

The above and other objects and advantages of the invention will appear more fully from consideration of the following detailed description of the preferred embodiment of the invention made with reference to the accompanying drawings.

DESCRIPTION OF THE DRAWINGS

FIG. 3 is a horizontal view of the actuator with a partial cross-section revealing the contoured surface, the D-shaped valve member and the clutch.

FIG. 4 is an exploded view of the D-shaped valve, the clutch and the associated hardware.

FIG. 5 is a left-hand view of the contoured surface of the actuator showing the D-shaped valve in a partially open position.

DESCRIPTION OF THE PREFERRED EMBODIMENT

Figure 1:
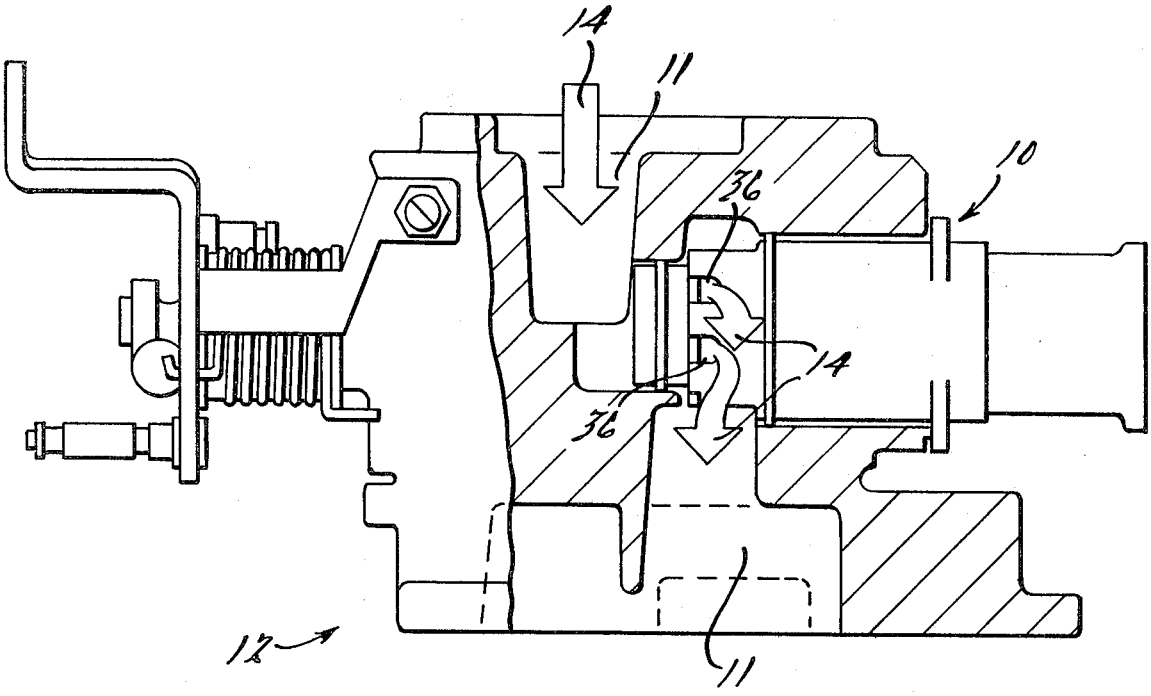
FIG. 1 shows the subject actuator assembled into a throttle body. The Figure also shows one type of throttle body in a partial cut-away view to illustrate one typical air-flow pattern through the assembly.

Referring to FIG. 1, the automatic idle speed actuator assembly 10 is shown mounted into a throttle body assembly 12. The separate air passage which by-passes the throttle blade in throttle body assembly 12 is shown as 11. The by-pass air is shown schematically in FIG. 1 with the use of arrows 14. It is to be appreciated that in different types of throttle body assemblies, the direction of the air-flow may be reversed.

Figure 2:
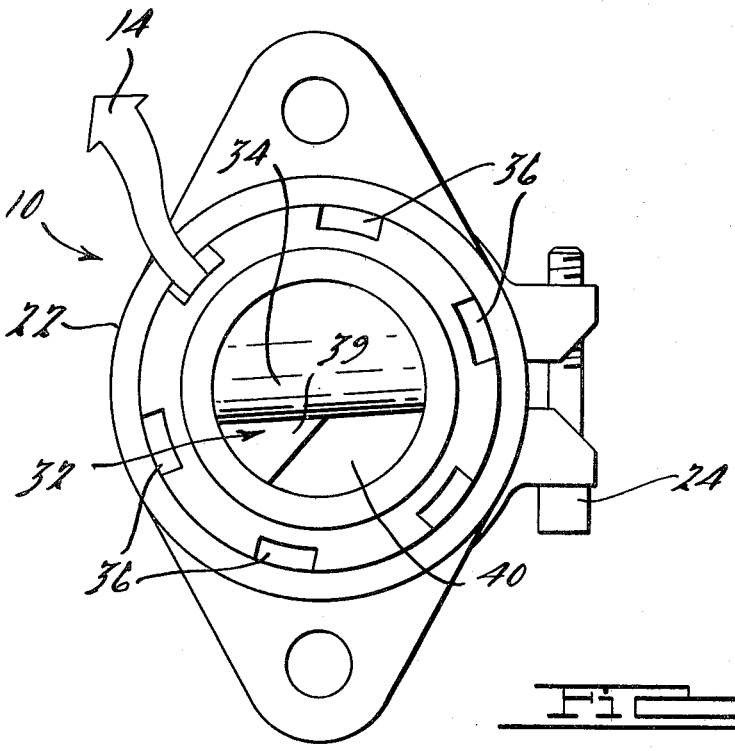
FIG. 2 is an end view of the actuator showing the D-shaped valve and orifice along one typical air-flow pattern through the actuator.

Referring to FIG. 2, the operation of the actuator assembly 10 and the movement of air-flow 14 is further illustrated. Shown in housing 22 along with contoured suface 34. Working with contoured surface 34 is the D-shaped disc 39. Contoured surface 34 and D-shaped disc 39 work together to vary the orifice opening 32. This allows the amount of air-flow received across contoured surface 34 to enter into orifice 32 and then be expelled through multiple-orifices 36. It is to be appreciated that this air-flow pattern can be reversed for different throttle body designs.

Referring now to FIG. 3, throttle body assembly 10 is featured in a partial cut-away view. The main exterior parts to the actuator assembly 10 are the valve assembly housing 22, the motor assembly 20 and the attachment flanges 26. These external components are all held together by means of motor retaining clamp 24.

Throttle body assembly 10 is inserted into the throttle body assembly 12 and is retained there by attachment means through flanges 26. A seal is made between throttle body assembly 12 and actuator assembly 10 by the combination of O-ring grooves 28 and 30 along with O-rings 29 and 31. The cut-away portion of FIG. 3 further shows the D-shaped orifice 32 for acceptance or exhaust of the air-flow. Also shown is contoured surface 34 and pivot pin 50. The valve element 38 is made up basically of D-shaped disc 39 and D-shaped notch 40. The valve element 38 contains a valve locating hole 48, shown in FIG. 4, to mate with pivot pin 50. The valve element 38 frictionally communictes with the bearing surface 35 by means of bearing surface 47 on D-shaped disc 39. Valve element 38 rotates about pivot pin 50 in such a manner as to open or close D-shaped orifice 32. The amount of D-shaped opening 32 which is encroached by D-shaped disc 39 determines the amount of air-flow 14 which passes through D-shaped orifice 32. The generally cylindrical housing member 22 contains multiple orifices 36 on the circumference of the housing. The multiple orifices 36 are allowed to communicate with the air-flow 14 by means of valve element 38. In the particular embodiment shown in FIG. 3 the air-flow 14 would be allowed to enter through D-shaped orifice 32 and flow past D-shaped notch 40 on out through one or several of the multiple orifices 36.

A more detailed view of operation of the actuator can now be approached by referring to FIGS. 3, 4 and 5. Valve member 38 also comprises a bearing surface 47 which aids in frictional communication between valve member 38 and bearing surface 35. Valve stops 44 protrude from the circumference of D-shaped disc 39 and communicate with housing stops 46 when the D-shaped valve element 38 is selectively rotated to its end of travel.

FIG. 4 is an exploded view which illustrates the valve and clutch assembly 37. Valve element 38 is generally cylindrical. Illustrated are exterior cylindrical clutch surface 54 and interior cylindrical clutch surface 53. Valve shaft means 52 mates with reaction plate bore 66 to centrally locate reaction member 57 into valve element 38.

Reaction member 57 is comprised of reaction plate 62 which frictionally communicates within the interior of valve element 38 on interior clutch surface 53. The reaction member 57 is held in place with the valve element 38 by means of retaining clip 68 which fits over valve shaft 52.

Reaction member 57 further comprises tabs 64 which radially project from the circumference of the reaction member.

The last major portion of the valve and clutch assembly 37 is the multi-fingered clutch member 56. The multi-fingered clutch member 56 is of generally cylindrical shape as is valve element 38 and reaction member 57. A spring 70 inserts between reaction member 57 and multi-fingered clutch 56. The cylindrical wall of multi-fingered clutch member 56 is made up of fingers 59. It is open at one end. The multi-fingered clutch member 56 further comprises a clutch torque ring groove 58. The multi-fingered clutch member 56 slides over valve element 38 and reaction member 57 such that the tabs 64 insert between the fingers 59 and past clutch torque ring groove 58 of multi-fingered clutch 56. The clutch torque ring 60 then slides over the assembly 37 and into clutch torque ring groove 58 thereby locking the assembly.

The spring 70 urges communication between the reaction member 57 and the valve element 38. The multi-fingered clutch 56 communicates with the radially projecting tabs 64 of reaction member 57 and is resiliently mated to the reaction member 57 via the spring 70. The clutch torque ring 60 provides frictional contact and retaining force between reaction member 57 and the multi-fingered clutch member 56.

In general the operation of the actuator is as follows:

The air passage represented by D-shaped orifice 32, the contoured surface 34, D-shaped notch 40 and valve element 38, along with multi-orifices 36 controls the amount of air-flow 14 into the throttle body assembly 12 for idle speed control. The amount of air-flow 14 is determined by the relative position of the D-shaped orifice 32 and the valve element 38. The maximum air-flow 14 of the valve fully open is determined by the shape of the contoured surface 34, the size and shape of the D-shaped notch 40, and the size and shape and number of the multiple orifices 36.

The minimum air-flow of the valve fully closed is determined by the bearing surface height 47 and the loading produced by the spring 70.

The clutch prevents the stalling of the motor when the valve assembly reaches its stop position, either full open or full closed, thereby preventing the high current associated with the stall of the motor. Communication between the actuator valve and the motor is provided by a gear reduction assembly means and shaft blocked out as 19 in FIG. 3. Motor controls are not shown but in general comprise decision making circuitry and software which energizes the motor with the desired polarity for the desire time period.

The subject valve works by sliding its valve members perpendicular to engine vacuum. The subject valve therefore requires a small force to actuate. Other types of idle speed motors actuate valve members in the same direction as engine vacuum. Overcoming the vacuum to open the air by-pass orifice to by-pass air requires stronger, heavier and larger motors than the subject valve.

Although D-shaped pieces and orifices are utilized in the preferred embodiment, other shaped valve members, discs and orifices etc., could also be used depending on the application. The D-shape employed in the preferred embodiment lends itself well to the required air-flow in an air by-pass orifice.

The material of which the multi-fingered clutch 56 is made and also the material of the valve 38 and the exterior clutch surface 54 are selected specifically to have specific friction coefficients. These materials when combined with the loading of clutch torque ring 60 allows a motor current during clutch operation or clutch slip that is not much higher than actual operation current. In one typical embodiment of the subject invention, the multi-fingered clutch is made of a nylon based material and the valve element is made of sintered iron. Also, the clutch torque ring is made of steel wire, the wire diameter of the ring is selected to provide proper loading on the multi-fingered clutch assembly to give the right clutch frictional surface characteristics.

While the above description constitutes the preferred embodiment of the present invention, it will be appreciated that the invention is susceptible to modification, variation and change without departing from the proper scope or fair meaning of the accompanying claims.

What is claimed is:

1. In a throttle body for supplying air and/or fuel to an engine and having a valve first passage for the air or air/fuel mixture, and a second passage for supplying air during idle when the first passage is substantially closed, a selectively rotatable actuator means to control the flow of air through the second passage comprising:
   - a housing having a generally cylindrical bore open at one end to communicate with an air flow;
   - multiple orifices around the circumference of said housing to further communicate with said air flow;
   - housing stops mounted on the interior circumference of said generally cylindrical bore;
   - flow directing means partially across said bore defining a shear edge, having a pivot pin and defining an orifice in said generally cylindrical bore;
   - a rotatable valve element supported by said bore;
   - a disc on said valve element;
   - valve stops located on the outside circumference of said disc to communicate with said housing stops when said valve element and disc is selectively rotated to its end of travel;
   - and drive means to selectively rotate said valve element and disc within said cylindrical bore in said housing to allow the metering of an air-flow through said actuator; and
   - clutch means to communicate between said drive means and said valve element.

2. A valve element in an automatic idle speed actuator as described in claim 1 further comprising:
   - a generally cylindrical body;
   - a disc at one end of said body and of larger diameter than said body;
   - a notch depending from said disc to work with said disc and said flow directing means to selectively and proportionately meter intake air around said throttle blade.

3. A valve element in an automatic idle speed actuator as described in claim 2 further comprising;
   - a valve locating hole to mate with said pivot pin; and
   - a bearing surface on said disc to frictionally communicate with said flow directing means.

4. A valve element as described in claim 3 further comprising:
   - an exterior clutch surface on the exterior circumference of said generally cylindrical valve element;

a bore in said generally cylindrical valve element opposite to said disc;

an interior clutch surface on the interior circumference of said bore; and a valve shaft projecting from the interior of said bore and attached to the interior surface of said disc.

5. An automatic idle speed actuator as described in claim 4 having clutch means comprising:

an exterior cylindrical clutch surface on said generally cylindrical valve body;

an interior cylindrical clutch surface in said generally cylindrical valve body;

a valve shaft;

a reaction member including a reaction plate to frictionally communicate within said clutch surface, a reaction plate bore to mate with said valve shaft on said valve element and tabs radially projecting from said reaction member;

a retaining clip to lock said valve shaft into said reaction plate bore;

a spring to urge the communication between said reaction member and said valve element;

a multi-fingered clutch member which communicates with said radially projecting tabs and is resiliently mated to said reaction member via said spring;

a clutch torque ring to provide frictional contact and retaining force between said reaction member and said multi-fingered clutch member; and a clutch torque ring groove in said multi-fingered clutch member to provide a seating position for said clutch torque ring.

6. An actuator as described in claim 1 wherein said disc is D-shaped and said orifice defined by said flow directing means is D-shaped.

7. A valve element as described in claim 2 wherein said disc is D-shaped and said notch is D-shaped.

8. A valve element as described in claim 3 wherein said disc is D-shaped.

9. A valve element as described in claim 4 wherein said disc is D-shaped.

10. An actuator having clutch means as described in claim 5 wherein said valve element is D-shaped.

* * * * *